US011342145B2

(12) United States Patent
Fernandez et al.

(10) Patent No.: US 11,342,145 B2
(45) Date of Patent: May 24, 2022

(54) PYROTECHNIC DEVICE WITH PLASTIC HOUSING

(71) Applicant: Autoliv Development AB, Vargarda (SE)

(72) Inventors: Philippe Fernandez, Saint Divy (FR); Ludovic Lageat, Brest (FR); Sebastien Cornec, Quimper (FR); Francois Gaudinat, Amblainville (FR); Gildas Clech, Plougastel-Daoulas (FR); Jean Champendal, Quimper (FR)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 17/293,782

(22) PCT Filed: Nov. 13, 2019

(86) PCT No.: PCT/EP2019/081176
§ 371 (c)(1),
(2) Date: May 13, 2021

(87) PCT Pub. No.: WO2020/099486
PCT Pub. Date: May 22, 2020

(65) Prior Publication Data

US 2022/0028638 A1 Jan. 27, 2022

(30) Foreign Application Priority Data

Nov. 16, 2018 (FR) ..... 1860595

(51) Int. Cl.
*H01H 39/00* (2006.01)
*H01H 9/04* (2006.01)

(52) U.S. Cl.
CPC ..... *H01H 39/006* (2013.01); *H01H 9/042* (2013.01)

(58) Field of Classification Search
CPC ..... H01H 9/042; H01H 39/00; H01H 39/006
See application file for complete search history.

(56) References Cited

U.S. PATENT DOCUMENTS 5,990,572 A * 11/1999 Yasukuni ..... H01H 39/006 180/271
6,107,581 A * 8/2000 Tanigawa ..... H01H 3/503 200/82 D (Continued)

FOREIGN PATENT DOCUMENTS

EP 0863528 A2 9/1998
EP 0929090 A2 7/1999

(Continued)

*Primary Examiner* — Jacob R Crum
(74) *Attorney, Agent, or Firm* — Harness, Dickey & Pierce, P.L.C.; Stephen T. Olson

(57) ABSTRACT

The invention relates to a pyrotechnic switch, which comprises, a housing formed by a first housing part that is assembled with a second housing part, and at least one pyrotechnic actuator arranged in the housing, wherein at least one out of the first housing part or the second housing part comprises a metal reinforcement and a plastic body overmolded onto the metal reinforcement, wherein the plastic body comprises, a first portion made of a first plastic material, and a second portion made of a second plastic material.

18 Claims, 5 Drawing Sheets

(56) References Cited

U.S. PATENT DOCUMENTS

| | | | | |
|---|---|---|---|---|
| 6,295,930 | B1 * | 10/2001 | Kume | H01H 39/006 102/202.5 |
| 2016/0343524 | A1 * | 11/2016 | Gaudinat | H01H 39/006 |
| 2017/0275458 | A1 * | 9/2017 | Lee | C08L 77/06 |
| 2017/0323747 | A1 * | 11/2017 | Burger | H01H 39/006 |
| 2019/0206646 | A1 * | 7/2019 | Yamada | H01H 39/00 |

FOREIGN PATENT DOCUMENTS

| | | | | |
|---|---|---|---|---|
| EP | 0936648 | A2 | 8/1999 | |
| FR | 3017240 | A1 | 8/2015 | |
| WO | WO-2018003594 | A1 * | 1/2018 | H01H 39/006 |

* cited by examiner

[Figure 1]
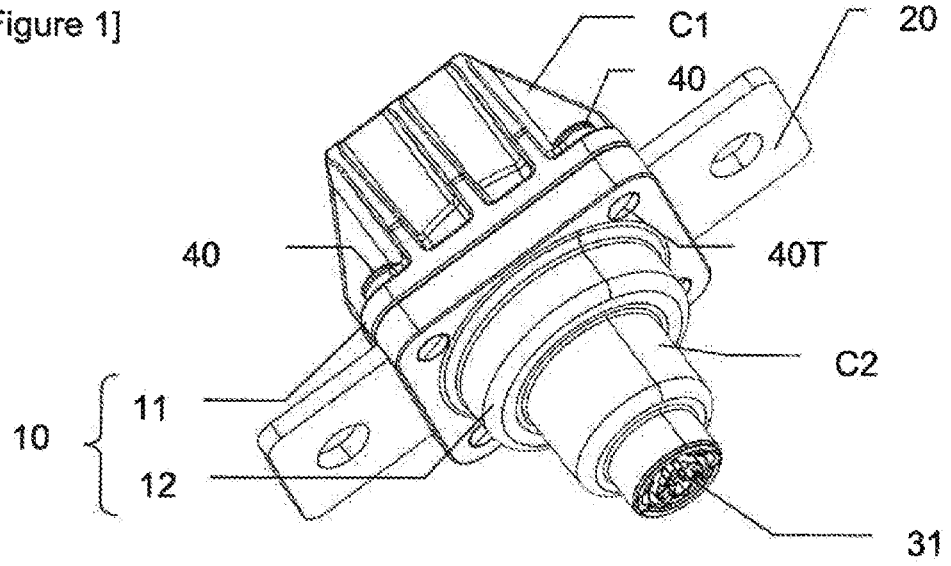
[Figure 2]
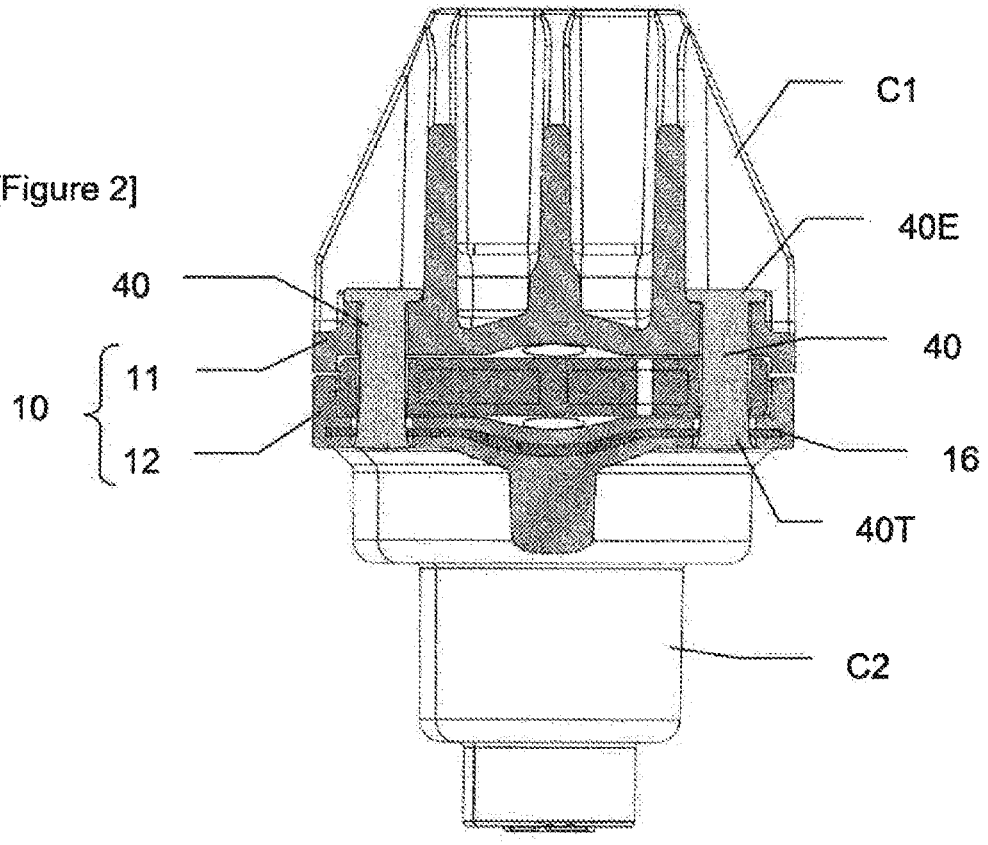

[Figure 3]
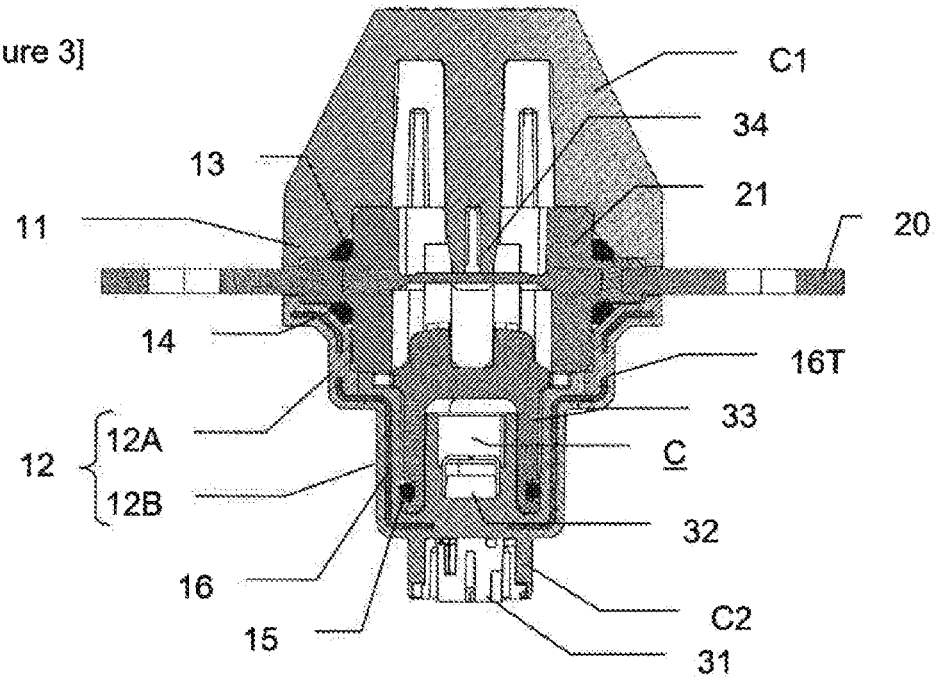
[Figure 4]
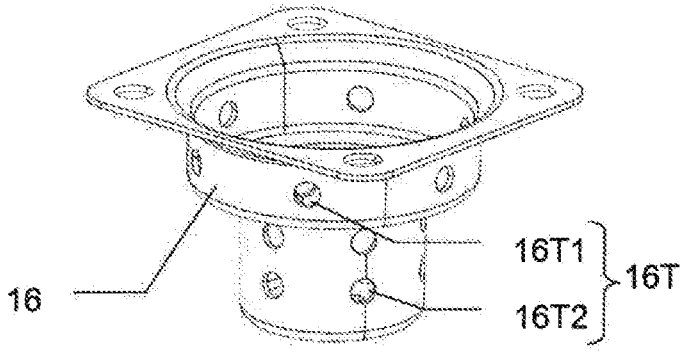

[Figure 5]
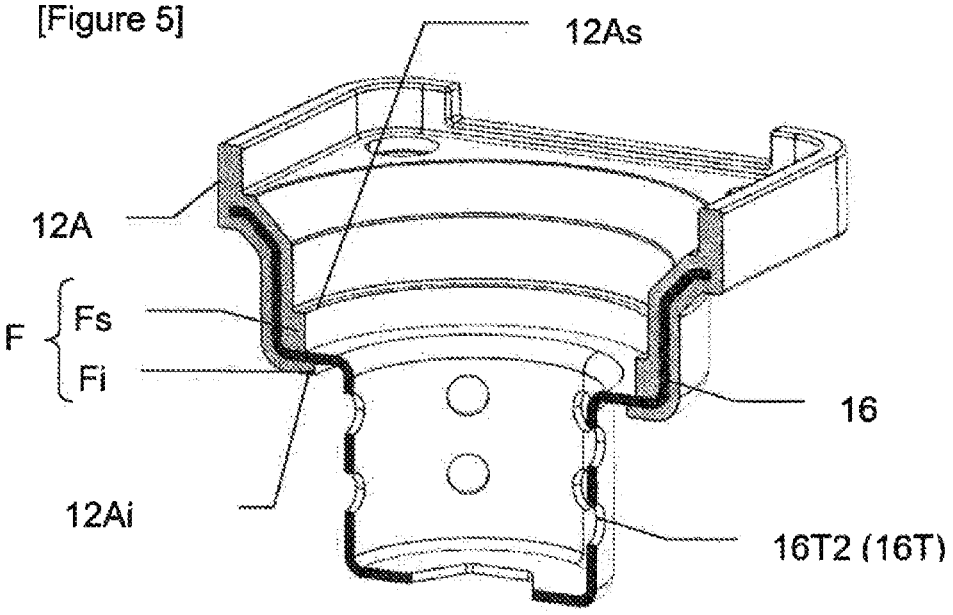
[Figure 6]
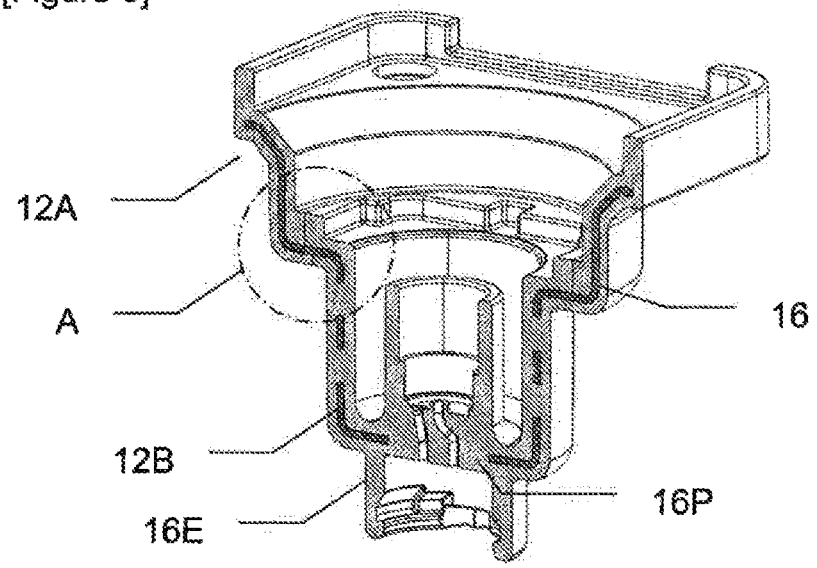

[Figure 7]
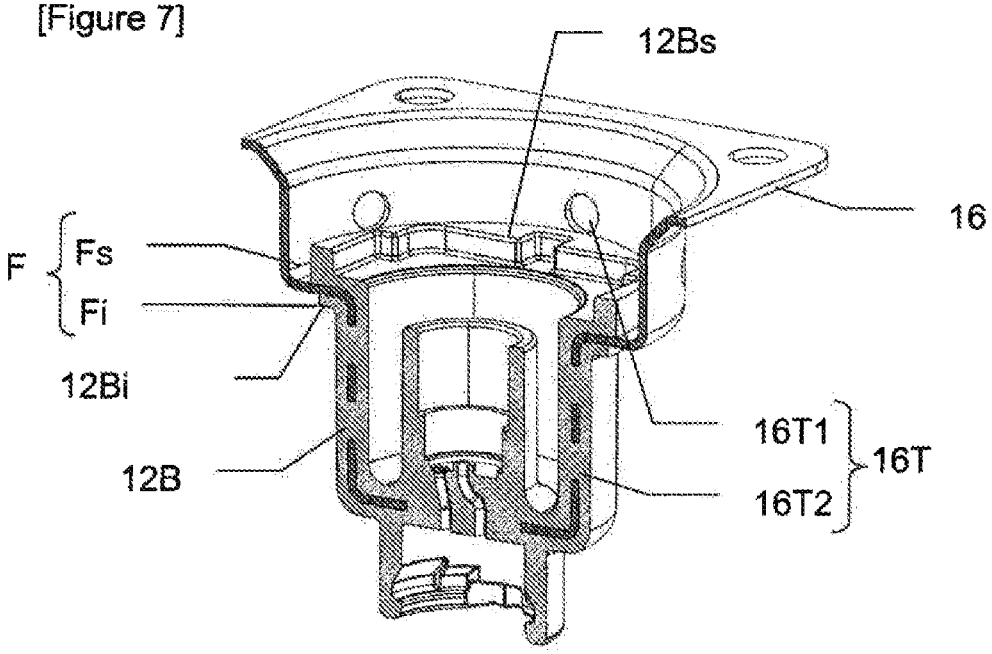
[Figure 8]
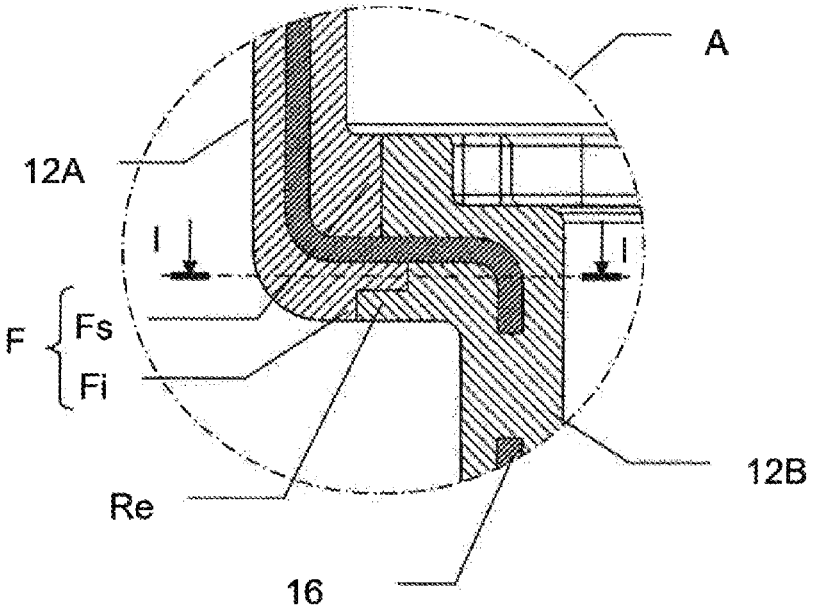

[Figure 9]
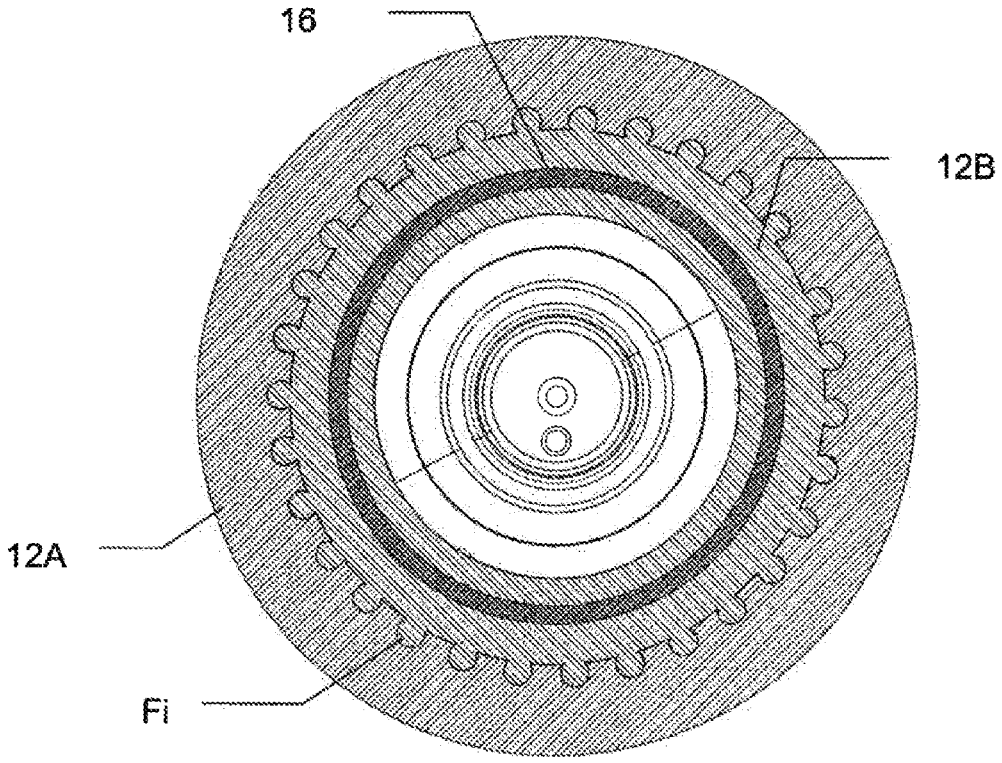

PYROTECHNIC DEVICE WITH PLASTIC HOUSING

The present invention relates generally to a pyrotechnic device, for example a pyrotechnic switch, intended to be mounted on a motor vehicle.

Pyrotechnic devices that form a switch (to open or close an electrical circuit of a motor vehicle, such as a high-power circuit), with for example a housing made of plastic material, are known from the prior art. Such a device is disclosed for example in document FR3017240. However, such a housing made of plastic material may bring restrictions or limitations in terms of geometry and/or mechanical strength. Indeed, it may be difficult to provide complex shapes since such complex shapes are not easy to manufacture with an injection molding process. Document EP0936648A2 discloses a pyrotechnic switch with a metal housing, a housing body made of synthetic resin and a coating made of synthetic resin. Document EP0929090A2 discloses a pyrotechnic circuit breaker having a support bracket riveted onto a housing part.

Moreover, due to the internal pressure, it is also necessary to provide a strong plastic material, which may for example pose problems with being injected into a mold with complex shapes. Indeed, the conditions for injecting plastic materials are different from one another causes specific injection restrictions. Moreover, a plastic raw material which is mechanically stronger than a second plastic material will not necessarily make it possible to obtain shapes which are more easily producible with the second plastic material.

One aim of the present invention is to respond to the disadvantages of the prior art documents mentioned above and in particular, first of all, to propose a pyrotechnic device such as a pyrotechnic switch or contactor, which has a housing made of robust plastic material, responding to restrictions associated with managing an electrical current while however having complex shapes or geometry.

To this end, a first aspect of the invention relates to a pyrotechnic switch comprising:

a housing, formed by a first housing part assembled with a second housing part;

at least one pyrotechnic actuator arranged in the housing;

wherein at least one of the first housing part or the second housing part comprises a metal reinforcement and a plastic body overmolded onto the metal reinforcement, characterized in that the plastic body comprises:

a first portion made of a first plastic material, a second portion made of a second plastic material.

The switch according to the above implementation comprises at least one bi-material plastic housing part, which makes it possible to combine the advantages of each material to manufacture a housing or a housing part which can offer both good mechanical and/or electrical strength in areas exposed to high forces or mechanical stresses, and also areas with complex and precise geometries where precision is required, due, for example, to assembly or linking to surrounding parts. Using several plastic materials makes it possible to produce the housing part in several injections. This makes it possible to use smaller presses and to be more flexible in order to adapt to the client's needs when the housing comprises a connection interface which the client wishes to personalize. Finally, when the housing comprises a pyrotechnic actuator, this makes it possible to be able to inject the housing at different suppliers; this may prove useful because handling pyrotechnic actuators may require specific security clearance. The plastic body is overmolded onto the metal reinforcement: this involves melting or molding a part (in this instance the plastic body) onto another already existing part (the metal reinforcement). The invention thus relates to a plastic body obtained by an operation for molding the plastic material in liquid form in a mold, on or around the metal reinforcement positioned beforehand in the mold. Typically, the overmolding is carried out by pressurized injection.

More generally, the invention relates to a pyrotechnic device forming a switch and/or a contactor, and comprising:

a housing, formed by a first housing part assembled with a second housing part;

at least one pyrotechnic actuator arranged in the housing;

wherein at least one of the first housing part or the second housing part comprises a metal reinforcement and a plastic body overmolded onto the metal reinforcement, characterized in that the plastic body comprises:

a first portion made of a first plastic material, a second portion made of a second plastic material.

At least one housing part of the pyrotechnic device (switch) consists of a metal reinforcement and two portions made of different plastic materials. This makes it possible to choose materials suitable for the local functions and geometries of each area of the housing part in question.

Advantageously, the switch comprises a boundary arranged between the first portion and the second portion. A boundary is used here to refer to an interface, linking area, connecting area, molding limit or interface where first and second material join. Positioning this boundary at the shoulder, which acts as a stiffener, makes it possible to limit the risks of material separation, while facilitating the molding operations, by providing planar areas for closing the injection molds.

Advantageously, the first plastic material and the second plastic material are interconnected at the boundary. The interconnection of two plastic materials makes it possible to limit the opening which could appear at the boundary due to differential expansions of the two materials. The interconnection may occur due to complementary nested shapes of the first plastic material in the second plastic material. Typically, the complementary shapes may have undercut shapes, for example with a dovetail shape along the boundary.

Advantageously, the first plastic material covers at least part of the second plastic material. The covering prevents the reinforcement from being exposed in the event of differential expansions of the plastic materials. When there is no interconnection of the two plastic materials, the deformation of one does not lead to the deformation of the other.

Advantageously, one of the first portion or the second portion has, at the boundary, at least one contact surface with a continuous periphery, in order to provide continuous contact for a mold for manufacturing the other of the first portion or the second portion. Such a continuous periphery (without recesses or leakage routes) makes it possible to provide a leaktight docking interface for the manufacturing mold provided for the following molding step.

In yet other words, the invention proposes a process for manufacturing a bi-material pyrotechnic switch, with a first step of injection molding a first portion with a plastic material, so as to manufacture at least one continuous contact surface, and with a second step of injection molding which comprises a phase of docking the manufacturing mold on said at least one contact surface, and maintaining this contact to ensure an absence of leaks during the second molding step. This makes it possible to simplify the manufacturing operations and tooling.

In particular, an outer surface of the first portion is flush, or aligned with, or on the same level as an outer surface of the second portion at the boundary.

Advantageously, two outer surfaces of the first portion are flush or aligned with, or on the same level as, respectively, two outer surfaces of the second portion at the boundary, the two surfaces of the two portions being located on either side of the metal reinforcement. In other words, on either side of the boundary, the surfaces are at the same level continuously.

Advantageously, the metal reinforcement is overmolded on both sides, and the boundary between the first portion and the second portion, arranged on one side of the metal reinforcement, is offset relative to the boundary between the first portion and the second portion, arranged on the other side of the metal reinforcement. In other words, there is an offset of the boundary between the two sides of the metal reinforcement, so as to further stiffen the assembly, in particular flexurally, and to limit the risk of delamination.

Advantageously, the metal reinforcement is overmolded on both sides by the first material and/or by the second material.

Advantageously, the boundary between the first portion and the second portion is an area in which the first plastic material is joined to the second plastic material.

Advantageously, the pyrotechnic switch comprises a movable part, housed in a guide interface made in one of the first portion or the second portion, and the boundary between the first portion and the second portion is discrete and/or separate from the guide portion. Such a separation makes it possible to guarantee correct guiding (therefore always carried out on the same continuous material), and prevents any damage to the join between the materials by the movable part.

Advantageously, the first portion has an internal wall arranged to be exposed or located in the vicinity of an electric arc during the operation of the pyrotechnic actuator, a part of the first plastic material being arranged to be removed by ablation. The first plastic material, exposed to or arranged in the vicinity of the electric arc, may be at least partially eroded or removed by ablation by the atmosphere and/or the electric arc, which increases the arc voltage and contributes to getting rid of, or limiting, the electric arc.

Advantageously, the first plastic material is selected from polyphthalamide (PPA), polyoxymethylene (POM) and poly (methyl methacrylate) (PMMA).

Advantageously, the second portion comprises a connection interface arranged to receive an electrical connector intended to connect the pyrotechnic actuator to a control circuit.

Advantageously, the second plastic material is selected from polyamide (PA, PA6, PA6-12, PA6-6) and comprises between 10% and 50% by weight of reinforcing fibers, for example made of glass. Such a material (polyamide, otherwise known as nylon), is well-suited to producing, by molding, complex shapes, typical of a connection interface, with grooves and channels requiring complex manufacturing molds.

Advantageously, the metal reinforcement comprises a plurality of overmolding openings, so as to enable overmolding of the plastic body on both sides of the metal reinforcement, and material continuity of the plastic body through the overmolding openings. The plastic body is then well anchored on the metal reinforcement, and the injection molding process and mold are simplified.

Advantageously, a first plurality of overmolding openings is arranged at the first portion, and a second plurality of overmolding openings is arranged at the second portion.

Advantageously, the metal reinforcement comprises at least one cylindrical portion delimited by a shoulder, and the boundary is located at the shoulder. The positioning of the boundary at the shoulder involves the same plastic material being present on either side of the connection radius between the shoulder and the remainder of the reinforcement. Thus, the strength of the housing part comprising two plastic materials is reinforced.

Advantageously, the shoulder is free of openings. Such a shoulder made of solid material provides good deformation resistance, which notably limits risks of breakage, cracks, leaks in operation, when the pyrotechnic actuator is ignited and generates high pressures (several tens of bars, or more).

Advantageously, the shoulder is planar.

Advantageously, the boundary between the first portion and the second portion is arranged at the shoulder.

Advantageously, the pyrotechnic actuator is overmolded in the first plastic material.

Advantageously, the metal reinforcement comprises a terminal shoulder defining a central hole, the pyrotechnic actuator being arranged in the central hole, and the terminal shoulder lacks other recesses. In other words, the terminal shoulder at which the igniter is overmolded is made of solid sheet metal, without holes or through-recesses for the plastic material, so as to guarantee good hold Advantageously, the other of the first housing part or the second housing part is an entirely plastic part, made of the second plastic material.

Advantageously, the pyrotechnic switch comprises rivets, wherein the first housing part is attached to the second housing part with the rivets, and wherein the metal reinforcement comprises through-holes for the rivets.

Advantageously, the pyrotechnic switch comprises an electrical conductor sandwiched between the first housing part and the second housing part.

Advantageously, the metal reinforcement is at least partially arranged on the outside, which simplifies the overmolding process (the plastic material is arranged on a single side of the metal reinforcement).

Advantageously, the metal reinforcement comprises protruding or recessed forms, such as humps or depressions, so as to increase the resistance to detachment, delamination or sliding (translationally or rotationally) between the metal reinforcement and the overmolded plastic materials.

A second aspect of the invention relates to a motor vehicle safety device, comprising a pyrotechnic switch according to the first aspect of the invention.

A third aspect of the invention relates to a motor vehicle, comprising at least one pyrotechnic switch according to the first aspect of the invention.

Other features and advantages of the present invention will become more apparent upon reading the following detailed description of an embodiment of the invention which is provided by way of entirely non-limiting example and illustrated by the attached drawings, wherein:

FIG. 1 shows a perspective view of a pyrotechnic device according to the invention;

FIG. 2 shows a sectional view of the pyrotechnic device of FIG. 1;

FIG. 3 shows another sectional view of the device of FIG. 1;

FIG. 4 shows a view of a metal reinforcement of the device of FIG. 1

FIG. 5 shows a section of a part of the housing of the pyrotechnic device of FIG. 1, at a first manufacturing stage;

FIG. 6 shows a section of a part of the housing of the pyrotechnic device of FIG. 1, at a second manufacturing stage;

FIG. 7 shows a manufacturing alternative for the pyrotechnic device of FIG. 1;

FIG. 8 shows a detail of FIG. 6, according to a particular embodiment;

FIG. 9 shows a section of FIG. 8, to show another particular embodiment.

FIG. 1 shows a perspective view of a pyrotechnic device according to the invention, comprising a housing 10 formed by a first housing part 11 and a second housing part 12. An electrical conductor 20 is sandwiched between the first housing part 11 and the second housing part 12.

The lower part of FIG. 1 shows a connection interface 31 of a pyrotechnic actuator 32 which is installed in the housing 10 and shown in FIG. 3.

This FIG. 3 shows the internal structure of the pyrotechnic device, arranged here as a switch provided for breaking the electrical conductor 20 if needed (breaking the vehicle power circuit in the event of an accident, for example).

To this end, the electrical conductor 20 carries an overmolded guide part 21, which forms a bore in which a punch 33 is placed, and which forms, with the second housing part 12, a combustion chamber C facing the pyrotechnic actuator 32 (in this instance an electro-pyrotechnic igniter, but it is possible to envisage an additional pyrotechnic booster if required). In FIG. 3, the punch 33 is in a rest position.

The first housing part 11 comprises, facing the punch 33 and on the other side of the electrical conductor 20, a counter-form 34 which may be considered to be an anvil or a matrix.

When it is necessary to break the electrical conductor 20, the pyrotechnic actuator 32 is ignited, which causes a large rise in pressure in the combustion chamber, such that the punch 33 is pushed toward the top of FIG. 3 in a translational movement from the rest position to a final position in which the electrical conductor 20 has been broken.

Considering that the pyrotechnic device is provided to be able to operate even after several years of service life and that, in operation, pressures of several tens of bars or more are anticipated, sealing means are provided between the first housing part 11, the second housing part 12, the guide part 21, with seals 13 and 14, according to the example shown. A seal 15 is also provided between the punch 33 and the second housing part 12.

It is understood that it is then necessary to guarantee good attachment between the first housing part 11 and the second housing part 12. However, in order to guarantee good electrical insulation, it is also necessary to provide for the housing 10 not to conduct electricity between the electrical conductor 20 and the ground of the vehicle, for example. In order to meet the latter condition, each housing part 11 and 12 has a plastic body C1 or C2. In order to meet the attachment condition, it is provided to rivet the housing parts 11 and 12 together, using rivets 40 which can be seen in FIGS. 1 and 2. Before assembling the housing, in order to guarantee efficient holding of the electrical conductor 20 and leaktightness of the device, the first housing part 11 and the second housing part 12 are not in contact.

FIG. 2 shows a section at the rivets 40, to illustrate the assembly. In particular, it is provided to arrange, in the second housing part 12, a metal reinforcement 16 so as to limit the stresses on the plastic body of this second housing part 12.

The rivets 40 are shoulder rivets. That is to say that, before riveting, they have a base 40E and a cylindrical body, so as to be able to be inserted into each housing part 11 and 12 which has a through-opening for the rivets 40. Each rivet 40 is subsequently deformed at the head 40T thereof, in order to finalize the assembly, guarantee leaktightness of the device and prevent any subsequent disassembly. According to this implementation, the heads 40T are embedded under, or flush with, the surface of the second housing part 12.

In practice, during this riveting operation, the base 40E of each rivet 40 is brought to bear against a base tool, and a setting tool (riveting tool) movable according to a particular movement to be at least temporarily inclined relative to the axis of the rivet 40 is brought into contact on the head 40T of the rivet 40 in order to apply a vertical force thereto, so as to crush and expand the head 40T by plastic deformation during the rotational and/or oscillating movement of the setting tool.

The riveting operation leads to deforming the head 40T so as to guarantee an axial stop of the second housing part 12, without thereby deforming the cylindrical part of the rivet 40, in particular at the base 40E.

As can be seen in FIG. 2, the plastic body C2 of the second housing part 12 has a wider through-opening than that of the metal reinforcement 16, such that the rivet 40, at the head 40E, only touches the second housing part 12 via the metal reinforcement 16. As a consequence, no radial force is applied by the rivet 40 to the plastic body C2. Risks of cracks, breakage or damage to the plastic are therefore prevented. In other words, the diameter for the passage of the rivet 40 into the plastic bodies C1 and C2 are greater than the diameter for the passage into the metal reinforcement 16.

This implementation guarantees that the rivet 40 only touches the second housing part 12 via the metal reinforcement 16, and swelling of the diameter of its stem does not lead to the rivet 40 coming into contact with either one of the plastic bodies C1 or C2.

Moreover, as the rivet 40 is not deformed at the base 40E thereof, it is not necessary to provide any metal reinforcement in the first housing part 11 to withstand the riveting operation, according to a preferred and optional implementation. The first housing part is therefore composed only of a plastic body C1 according to this implementation.

FIG. 4 shows an example of a metal reinforcement 16 which comprises holes 16T (which can be seen in FIGS. 4, 5 and 6), to enable continuity of the plastic material of the plastic body C2 of the second housing part 12, in order to facilitate the overmolding operation and obtain a solid plastic body C2.

The metal reinforcement 16 may be made of drawing steel of the type DC04-1.0338 (Re: 210-220 MPa, Rm: 270-350 MPa, A %>38%).

The plastic body C1 of the first housing part 11 may be made of polymer, such as polyamide (PA, PA6.6, PA6.12) or polyoxymethylene (POM), optionally loaded with reinforcing fibers, such as glass fibers, for example in a proportion of 25% to 35% by weight. The rivets 40 may be made of steel, copper, aluminum with a high elongation at break (A %>20%, for example).

Regarding the second housing part 12, it is composed of two plastic materials: a first portion 12*a* made of first plastic material and a second portion 12B made of second plastic material.

The connection interface 31 is therefore produced in the second portion 12B of the second housing part 12 which is manufactured with the second plastic material, and use may for example be made of polyamide (PA, PA6, PA6-12, PA6-6), and comprises between 10% and 50% by weight of reinforcing fibers, for example made of glass. In particular, polyamide PA6 may be chosen, with 30% glass fibers by weight. As a consequence, it is possible to provide shapes (grooves, recesses) of small dimensions but nonetheless precise, at the connection interface 31, since the second plastic material chosen is easy to inject into molds with complex shapes. Moreover, the second material chosen may also properly withstand the pressures present in the combustion chamber C due to the added reinforcing fibers.

Furthermore, the first portion 12A of the second housing part 12 which is manufactured with the first plastic material may be intended to be exposed, during operation of the switch, to an environment in which an electric arc is formed. According to such a scenario, a part of the first plastic material is arranged to be removed by ablation, and the first plastic material is selected from polyphthalamide (PPA), polyoxymethylene (POM), poly(methyl methacrylate) (PMMA).

FIG. 5 shows the second housing part 12 after a first injection molding operation during which the first portion 12A was injection-molded with the first plastic material.

FIG. 6 shows the second housing part 12 after a second injection molding operation during which the second portion 12B was injection-molded with the second plastic material.

FIG. 5 also shows that the first plastic material is molded up to a shoulder of the metal reinforcement 16, with an offset of a boundary F between the two sides of the metal reinforcement 16. Indeed, a lower boundary Fi (on the lower side of the metal reinforcement 16 in FIG. 5) has a smaller inner diameter than an upper boundary Fs, on the other side. The structure provides several advantages. Indeed, the shoulder of the metal reinforcement 16 is free of holes, and in combination with the offsetting of the boundary, this makes it possible to obtain good stiffness of the second housing part 12, and low deformations. This limits the risks of breakage, delamination, and cracking.

It is also possible to mention that the manufacturing mold for the second injection molding operation of the second plastic material may come to bear against the surfaces 12As and/or 12Ai of the first plastic material, at the boundary F, which also simplifies manufacturing.

Moreover, FIG. 8 shows more particularly the detail A illustrated in FIG. 6, corresponding to a particular implementation of the interface between the first and the second portion 12A, 12B, respectively. Indeed, to prevent any exposure of the metal reinforcement 16 to the outside, it may be advantageous to provide a covering for the materials, for example at the lower boundary Fi. Indeed, FIG. 8 shows a return Re of the second plastic material, below the first plastic material, which prevents the metal reinforcement 16 from being uncovered, even in the event of differential expansion of the plastic materials. In order to further improve the mechanical strength between these two portions, it may be advantageous to also provide nesting of the materials. The nesting and the covering may or may not be combined, depending on requirements.

Furthermore, FIG. 9 shows a section in the plane I-I of FIG. 8, to show a particular implementation of nesting of the materials. Indeed, FIG. 9 shows that the two plastic materials are nested one in the other, with undercuts at the lower boundary Fi. In FIG. 9, the complementary shapes have a cylindrical toothed contour or section, but it is possible to provide rectilinear dovetail shapes, for example. This implementation increases the strength of the boundary or interface between the two materials and further limits the risks of material separation or delamination. In the event that nesting of the materials is provided without the covering, the complementary shapes may be visible if they are arranged throughout the thickness of the plastic materials.

Regarding the metal reinforcement 16, the latter comprises holes 16T which can be seen in FIGS. 4, 5 and 7, which comprise holes 16T1 and 16T2, each dedicated to enabling continuity of the first plastic material and the second plastic material, respectively. Finally, the metal reinforcement 16 comprises, in the lower part thereof shown in FIG. 6, a shoulder 16E with a through-hole 16P for the pyrotechnic actuator 32 (which can be seen in FIG. 3 and not in FIG. 6, for the sake of clarity). The shoulder 16E is free of holes or recesses other than the through-hole 16P, so as to have adequate resistance to the forces and stresses present in this area during operation, due in particular to the pressures in the combustion chamber C.

FIG. 7 shows a manufacturing alternative, according to which the second plastic material is injected first. However, the boundary F always comprises an offset (Fs, Fi) between the two sides of the metal reinforcement 16, and contact surfaces 12Bs, 12Bi with a continuous perimeter to provide leaktight contact on the manufacturing mold for the subsequent overmolding operation.

It will be understood that different modifications and/or improvements which are obvious for the person skilled in the art may be made to the different embodiments of the invention described in this present description without departing from the scope of the invention.

The invention claimed is:

1. A pyrotechnic switch, the pyrotechnic switch comprising:

a housing formed by a first housing part assembled with a second housing part; and at least one pyrotechnic actuator arranged in the housing;

wherein at least one of the first housing part or the second housing part comprises a metal reinforcement and a plastic body overmolded onto the metal reinforcement as a liquid plastic material such that the metal reinforcement is embedded within the liquid plastic material of the plastic body, wherein the plastic body comprises:

a first portion made of a first plastic material, and a second portion made of a second plastic material.

2. The pyrotechnic switch according to claim 1, comprising a boundary arranged between the first portion and the second portion.

3. The pyrotechnic switch according to claim 1, wherein one of the first portion and the second portion has, at the boundary, at least one contact surface with a continuous periphery, in order to provide continuous contact for a mold for manufacturing the other of the first portion and the second portion.

4. The pyrotechnic switch according to claim 2, wherein the metal reinforcement is overmolded on both sides, and wherein the boundary between the first portion and the second portion, arranged on one side of the metal reinforcement is offset relative to the boundary between the first portion and the second portion, arranged on the other side of the metal reinforcement.

5. The pyrotechnic switch according to claim 1, comprising a movable part, the movable part housed in a guide interface made in one of the first portion and the second portion, and wherein the boundary between the first portion and the second portion is discrete and/or separate from the guide interface.

6. The pyrotechnic switch according to claim 1, wherein the first plastic material is selected from polyphthalamide (PPA), polyoxymethylene (POM), poly(methyl methacrylate) (PMMA).

7. The pyrotechnic switch according to claim 1, wherein the second portion is formed to define connection interface open at an axial end of the pyrotechnic switch and arranged to receive an electrical connector intended to connect the pyrotechnic actuator to a control circuit.

8. The pyrotechnic switch according to claim 1, wherein the second plastic material is selected from polyamide (PA, PA6, PA6-12, PA6-6) and comprises between 10% and 50% by weight of reinforcing fibers.

9. The pyrotechnic switch according to claim 1, wherein the metal reinforcement comprises a plurality of overmolding openings, so as to enable overmolding of the plastic body on both sides of the metal reinforcement, and material continuity of the plastic body through the overmolding openings.

10. The pyrotechnic switch according to claim 1, wherein the metal reinforcement comprises at least one cylindrical portion delimited by a shoulder, wherein the shoulder is free of openings.

11. The pyrotechnic switch according to claim 10, wherein the boundary between the first portion and the second portion is arranged at the shoulder.

12. The pyrotechnic switch according to claim 1, wherein the pyrotechnic actuator is overmolded in the second plastic material.

13. The pyrotechnic switch according to claim 1, wherein the metal reinforcement comprises a terminal shoulder defining a central hole, the pyrotechnic actuator being arranged in the central hole, and wherein the terminal shoulder lacks other recesses.

14. The pyrotechnic switch according to claim 13, comprising rivets, wherein the first housing part is assembled with the second housing part with the rivets, and wherein the metal reinforcement comprises through-holes for the rivets.

15. The pyrotechnic switch according to claim 1 in combination with a motor vehicle.

16. A pyrotechnic switch, the pyrotechnic switch comprising:

a housing formed by a first housing part assembled with a second housing part; and at least one pyrotechnic actuator arranged in the housing;

wherein at least one of the first housing part or the second housing part comprises a metal reinforcement and a plastic body overmolded onto the metal reinforcement, wherein the plastic body comprises:

a first portion made of a first plastic material, and a second portion made of a second plastic material, and wherein a boundary between the first and second portions on a first side of the metal reinforcement is offset relative to the boundary between the first and second portions on a second side of the metal reinforcement, the metal reinforcement overmolded on both the first side and the second side.

17. A pyrotechnic switch, the pyrotechnic switch comprising:

a housing formed by a first housing part assembled with a second housing part; and at least one pyrotechnic actuator arranged in the housing;

wherein at least one of the first housing part or the second housing part comprises a metal reinforcement and a plastic body overmolded onto the metal reinforcement, wherein the plastic body comprises:

a first portion made of a first plastic material, and a second portion made of a second plastic material, and wherein the metal reinforcement comprises at least one cylindrical portion delimited by a shoulder, wherein the shoulder is free of openings.

18. The pyrotechnic switch according to claim 17, wherein the boundary between the first portion and the second portion is arranged at the shoulder.

* * * * *